US005957199A

United States Patent [19]

McLean et al.

[11] Patent Number: 5,957,199

[45] Date of Patent: Sep. 28, 1999

[54] NATURAL GAS PRODUCTION OPTIMIZATION SWITCHING VALVE SYSTEM

[75] Inventors: Dan J. McLean; Robert W. Hughes, both of Calgary, Canada

[73] Assignee: Kenonic Controls Ltd., Calgary, Canada

[21] Appl. No.: 08/936,765

[22] Filed: Sep. 24, 1997

[30] Foreign Application Priority Data

Dec. 11, 1996 [CA] Canada ..... 2.192.607

[51] Int. Cl.[6] ..... E21B 43/12; E21B 47/06

[52] U.S. Cl. ..... 166/250.15; 166/53; 166/370

[58] Field of Search ..... 166/250.15, 369, 166/370, 53, 97.1, 316; 73/152.51

[56] References Cited

U.S. PATENT DOCUMENTS

| | | | |
|---|---|---|---|
| 1,949,323 | 2/1934 | Otis | 166/370 |
| 3,396,793 | 8/1968 | Piper et al. | 166/53 |
| 3,678,997 | 7/1972 | Barchard | 166/53 |
| 3,863,714 | 2/1975 | Watson, Jr. | 166/53 |
| 4,150,721 | 4/1979 | Norwood | 166/53 |
| 4,509,599 | 4/1985 | Chenoweth et al. | 166/370 |
| 5,132,904 | 7/1992 | Lamp | 166/53 X |
| 5,636,693 | 6/1997 | Elmer | 166/370 |
| 5,735,346 | 4/1998 | Brewer | 166/250.15 X |

*Primary Examiner*—George Suchfield
*Attorney, Agent, or Firm*—Thomas E. Malyszko

[57] ABSTRACT

A process for optimizing natural gas production from a well in the presence of liquids is provided where the well has a casing and a tubing landed therein for producing gas and removing the liquids. The process involves the steps of: opening the casing for gas production and closing the tubing to fluid flow; monitoring differential pressure between the open casing and the closed tubing; detecting a loaded well upon the differential pressure reaching a Well Differential Set Point value; switching gas production to the tubing by closing the casing and opening the tubing; monitoring pressures of the closed casing and the open tubing; removing liquids from the well through the tubing, during which time at least some gas production continues through the tubing during the liquid removal; and, returning gas production to the casing when the well is unloaded of liquid by repeating the above procedure.

21 Claims, 5 Drawing Sheets

NATURAL GAS PRODUCTION OPTIMIZATION SWITCHING VALVE SYSTEM

FIELD OF THE INVENTION

The present invention relates to a system of retrieving liquids from natural gas wellbores, and in particular to use of switching valve technology and a method for optimizing natural gas production in the presence of such liquids.

BACKGROUND OF THE INVENTION

Operational problems are typically encountered when producing natural gas wells with high gas liquid ratios (GLRs), particularly during winter conditions in northern climates. Automation technology presently provides a means of relieving a wellbore of such liquids in a controlled manner in order to free production casing capacity where problem wells are produced by a tubing string.

The present invention addresses the implementation of switching valve technology and a method for optimizing a well's natural gas production by: first, using the well's casing as a primary production string to advantageously increase flow rates through a casing area which is larger than that of the tubing; second, maintaining some gas flow when removing liquid by avoiding the need to shut in the well during liquid loading; and third, automatically maintaining low liquid levels within the well to promote maximum flow rates.

SUMMARY OF THE INVENTION

In one aspect the invention provides a process for optimizing natural gas production from a well in the presence of liquids, said well having a casing and a tubing landed therein for producing said gas and removing said liquids, said process comprising the steps of:

(a) opening the casing for said gas production and closing said tubing to fluid flow;

(b) monitoring differential pressure between said open casing and said closed tubing;

(c) detecting a loaded well upon said differential pressure reaching a Well Differential Set Point value;

(d) switching gas production to said tubing by closing said casing and opening said tubing;

(e) monitoring pressures of said closed casing and open tubing;

(f) removing said liquids from the well through said tubing, wherein at least some gas production continues through said tubing during said liquid removal; and, (g) returning gas production to said casing when said well is unloaded of said liquid by repeating steps (a) to (g).

In another aspect the invention provides a method of optimizing natural gas production from a well in the presence of liquids, said well having a casing and a tubing landed therein in a substantially parallel relationship for transporting fluids under pressure from said well, said casing being initially open for gas flow and said tubing being closed to fluid flow, said method comprising the following cycle:

monitoring differential pressure between said open casing and said closed tubing;

detecting a loaded well upon said differential pressure reaching a Well Differential Set Point value selected to avoid overloading said well with said liquids;

switching production to said tubing by closing said casing and opening said tubing, wherein said switching is initiated no sooner than a Minimum Casing Flow time and no later than a Maximum Casing Flow time from opening of said casing;

removing said liquids from said well through said tubing, wherein at least some gas production continues through said tubing during said liquids removal;

monitoring for pressure increases in said open tubing wherein a Minimum Pressure Increase value indicates when said closed casing is considered charged, and, after reaching said Minimum Pressure Increase value, further monitoring said pressure increases for a Low Rate of Change value;

returning production to said casing by opening said casing and closing said tubing when said Low Rate of Change value is reached, wherein said returning is initiated no sooner than a Minimum Tubing Flow time and no later than a Maximum Tubing Flow time from said switching production; and, repeating said cycle to continue said optimized gas production.

In yet another aspect the invention provides a switching valve system for a natural gas well using the above process for optimizing natural gas production, said well having a casing and a tubing landed in said well for transporting pressurized fluids from said well, said system comprising:

a casing valve for opening and closing said casing to fluid flow;

a tubing valve for opening and closing said tubing to fluid flow;

a first pressure transmitter located up-stream of said casing valve for monitoring fluid pressure therein; and, a second pressure transmitter located upstream of said tubing valve for monitoring fluid pressure therein.

DESCRIPTION OF THE DRAWINGS

Embodiments of the invention will now be described, by way of example only, with reference to the accompanying drawings, wherein.

DESCRIPTION OF PREFERRED EMBODIMENT

Figure 1:
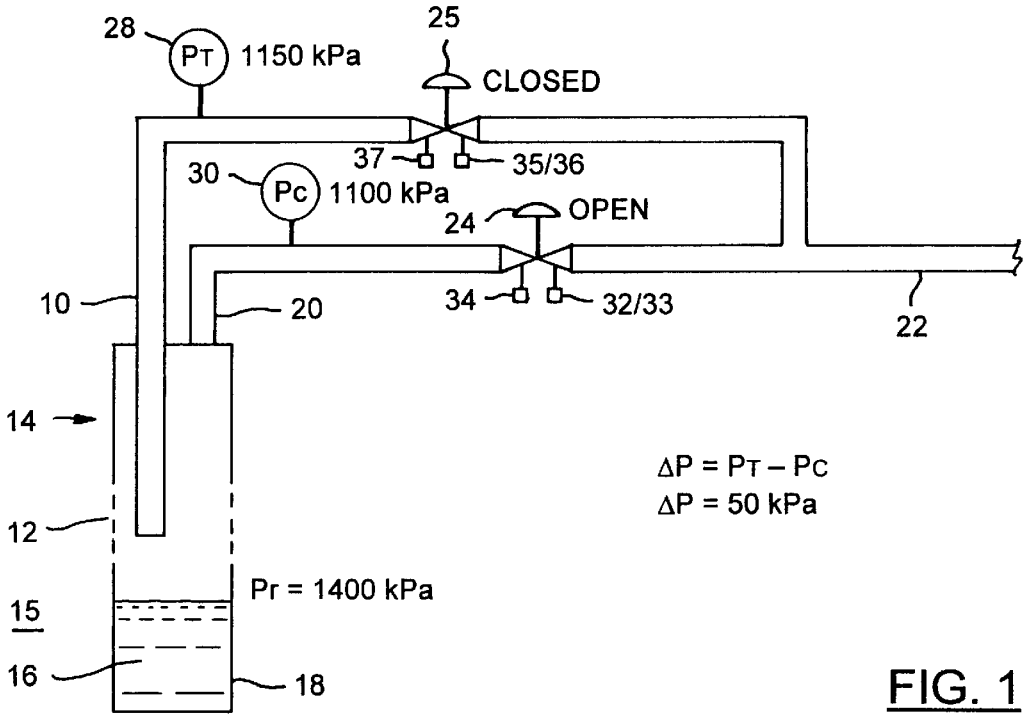
FIG. 1 illustrates a "New Well" scenario with a liquid level below a tube string and some desirable instrumentation for the present system.

The switching valve system of the present invention monitors, in real time, tubing and casing pressures of a natural gas well and determines, based on a well differential pressure set point, when the well has loaded up with unwanted liquid. Once this loaded condition is detected, procedures are undertaken to unload the well of the liquid. The well is then monitored to determine when it is clear of the liquid or if a preset unloading time is reached. When the well is unloaded or the preset time is reached, production is switched back to the primary string (namely, to the casing which has a larger cross-section area than the tubing), thus maximizing primary production time.

As gas flows from the well, liquid will typically accumulate in a sump. When the level of the liquid reaches the bottom of the tubing string, the tubing pressure is locked in, which is termed a "clean well". Assuming that the tubing is landed in a perforated region of the well's casing, the differential pressure (between the tubing and casing pressures) remains steady as the liquid level begins to rise. Once the liquid has passed the top of the perforations, the casing pressure begins to drop due to the liquid load, resulting in an increase of the well differential pressure.

Once the well differential pressure set point is reached, the switching valve system automatically switches the production string to the tubing and closes the casing. With the casing closed, the pressure within the casing begins building toward the pressure of the reservoir. The tubing pressure, on the other hand, decreases to equalize with surface distribution pressure, thus settling to a constant value. It should be noted that at this juncture the well is not shut in, and so natural gas production continues as the gas bubbles through the liquid and flows up the tubing. As pressure continues to build in the casing, it reaches a point where it is able to overcome the pressure of the liquid load, as well as the flow friction pressure drop and the above-ground or surface flow pressure. When such casing pressure is reached, it begins to push the liquid up the tubing, commonly termed a manometer effect. The manometer effect is accompanied by an increase in the tubing pressure and continues until all liquid above the terminal end (ie. bottom) of the tubing has been forced out of the well. The tubing pressure stabilizes when all liquid above the terminal end of the tubing has been removed, which triggers the switching valve system to switch the production string back to the casing.

The switching valve technology ensures that once production is switched to the tubing, it is maintained in the tubing as briefly as possible since the tubing is a smaller size than the casing, and so has a lower gas flow rate than the casing. Such optimal switching is achieved by monitoring tubing flow time and limiting such flow time before the well is automatically switched back to the primary production string, namely the casing. Additionally, the switching valve system monitors the casing flow time so that the cycle is automatically initiated to prevent the well from becoming overloaded. Lastly, pressure set points control the minimum time spent on either the casing or tubing production strings. This creates an effective deadband region and provides time for equilibrium to be reached once tubing and casing shut-off valves have been switched.

A example will now be presented to demonstrate operation of the switching valve system of the present invention. The operation is illustrated sequentially in FIGS. 1 to 7. It is understood that the pressure and set point values used in this example are for illustrative purposes only. In the example we assume that the tubing (designated by reference numeral 10 in FIGS. 1–7) is landed in, or extends to, the middle of a perforated region 12 of a well 14, and that the reservoir 15 has a pressure (Pr) of 1400 kPa (aprox. 200 psi).

FIG. 1 illustrates a "New Well" scenario where the level of a liquid 16 in a sump 18 is below the perforations 12 and below the landed tubing 10. In this New Well situation the natural gas flows freely from the relatively high pressure reservoir 15 through the perforations 12 and up a casing 20 to a lower pressure surface pipe 22. A casing valve 24 indicates that the casing is open for gas flow, and a tubing valve 25 indicates that the tubing 10 is closed. In this scenario the reservoir pressure (Pr) is 1400 kPa while the tubing pressure (Pt) is 1150 kPa and the casing pressure (Pc) is 1100 kPa. The drop from the reservoir pressure to the tubing and casing pressures is caused by friction and head loss of the gas as it moves up the well. With the noted pressure values the differential pressure (ΔP), namely Pt minus Pc, is 50 kPa. This is the equilibrium pressure of the New Well and will be maintained for as long as the liquid 16 gathering in the well 14 can be stored in the sump 18.

Figure 2:
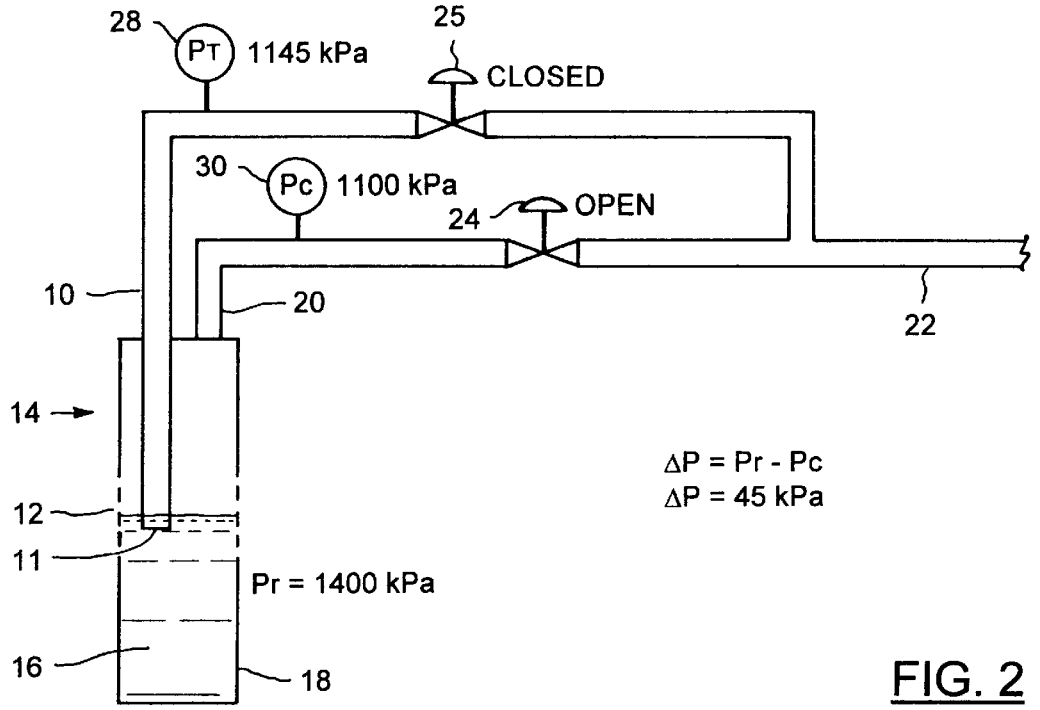
FIG. 2 illustrates a "Clean Well" scenario with the liquid level at the bottom of the tube string.

FIG. 2 illustrates a "Clean Well" scenario. As the liquid 16 reaches the terminal end 11 (ie. the bottom) of the tubing string 10 it causes a slight reduction in the tubing pressure to 1145 kPa. The pressure reduction is a result of the frictional loss of the liquid as it attempts to move up the tubing. This new pressure within the tubing will then remain constant until the liquid is removed below the terminal end 11 or the tubing valve 25 is opened. The differential pressure (ΔP) is now 45 kPa, which becomes the target pressure for a Clean Well after any excess liquid has been removed.

Figure 3:
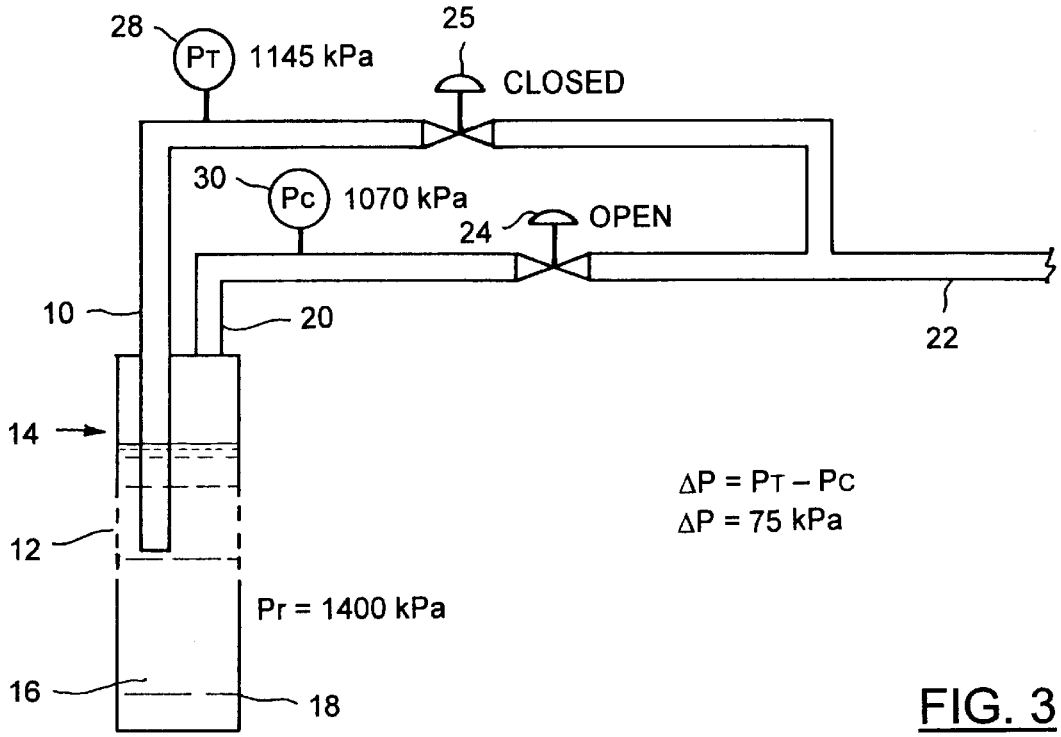
FIG. 3 illustrates a loaded well where the liquid has filled a sump.

FIG. 3 shows a "Loaded Well" where the liquid 16 fills the sump 18 above the perforations 12. This causes gas to bubble through the liquid and the casing pressure (Pc) to drop to 1070 kPa. The pressure differential is now 75 kPa. Assuming that this pressure differential is the predetermined or target set point, the switching valve system may now take action by first closing in the casing 20 and then opening the tubing 10 (see FIG. 4 below).

Figure 4:
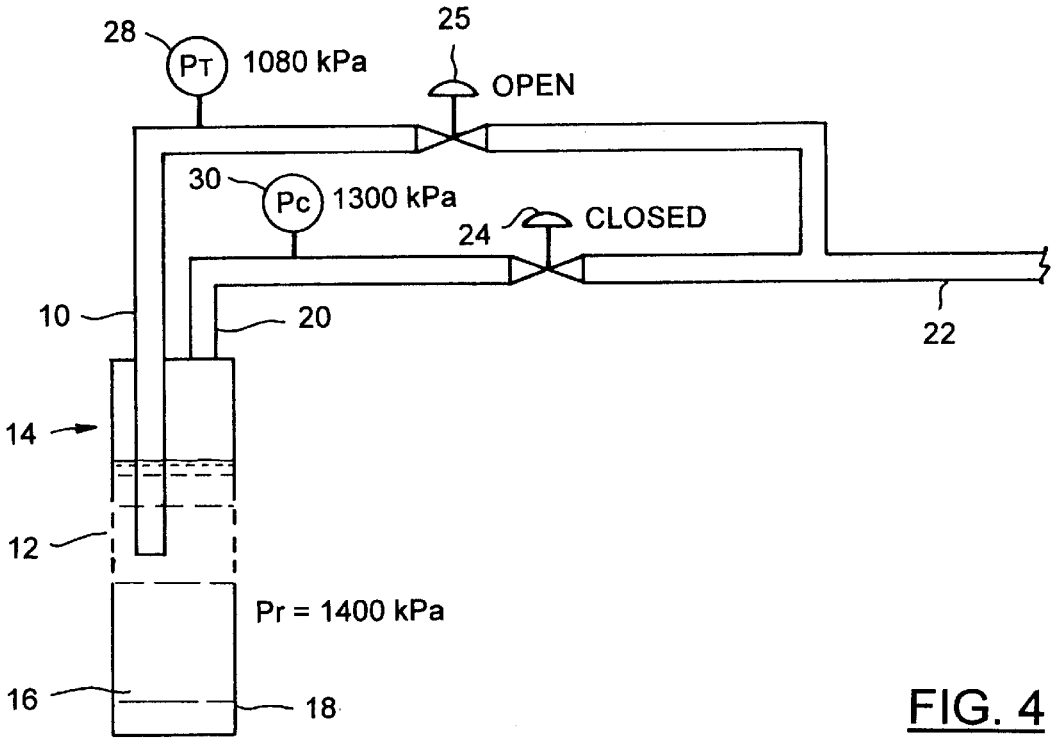
FIG. 4 illustrates a pressure rise in a casing cavity.

FIG. 4 shows "Charging of the Casing" where the casing valve 24 is closed to shut in the casing 20, and tubing valve 25 is opened. The production of the tubing 10 causes its pressure (Pt) to drop to 1080 kPa, and the casing pressure (Pc) begins to rise towards the reservoir pressure (Pr). This rise in the casing pressure (Pc) to 1300 kPa in FIG. 4 is due to the fact that the casing 20 is now shut in.

Figure 5:
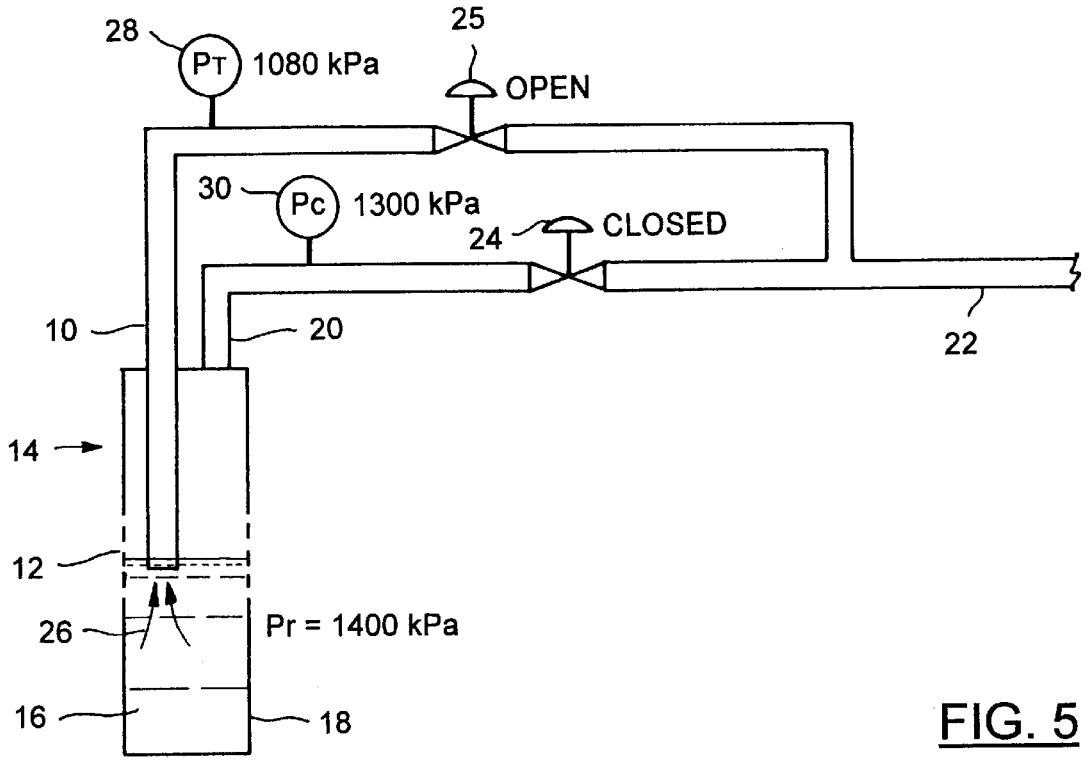
FIG. 5 illustrates a "U" tube effect where the casing pressure is fully charged.

As the pressure in the casing rises, it reaches a pressure capable of causing the manometer effect. The resultant pressure (Pc) pushes the liquid up the tubing 10 (indicated by arrows 26), and therefore begins to draw down the liquid level. In FIG. 5 the casing pressure (Pc) has risen to 1300 kPa, namely a fully charged pressure, and the tubing pressure (Pt) has increased to 1080 kPa as a result of the liquid flow.

Figure 6:
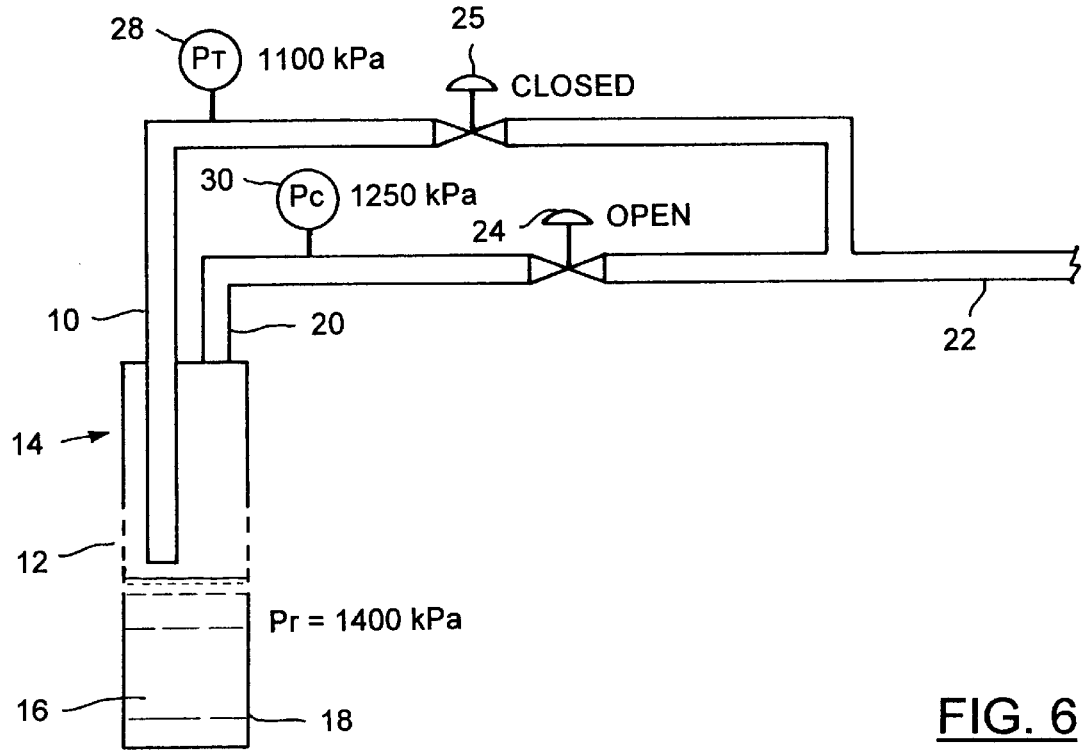
FIG. 6 illustrates a return to the Clean Well scenario with production ready to switch to the casing.

Referring now to FIG. 6, the well has unloaded the liquid 16 to the bottom of the tubing string 10. The well has returned to the Clean Well scenario and production may now switch back to the casing 20 by opening valve 24 and closing valve 25. The casing pressure (Pc) has dropped to 1250 kPa and the tubing pressure (Pt) has stabilized at 1100 kPa.

Figure 7:
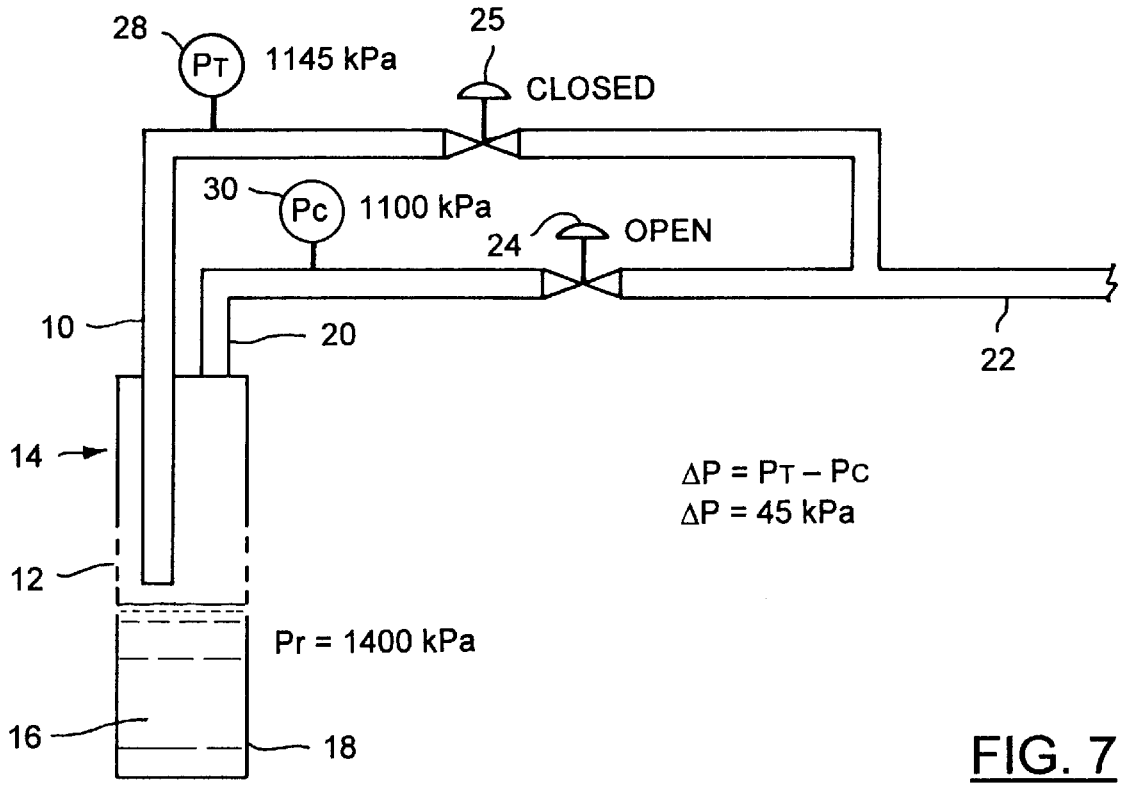
FIG. 7 illustrates production returned to the casing.

In FIG. 7 production has now returned to the casing 20 and to the target differential set point 75 kPa (see earlier discussion for FIG. 3). The system is ready to begin the cycle again when the liquid level rises again.

Figure 8:
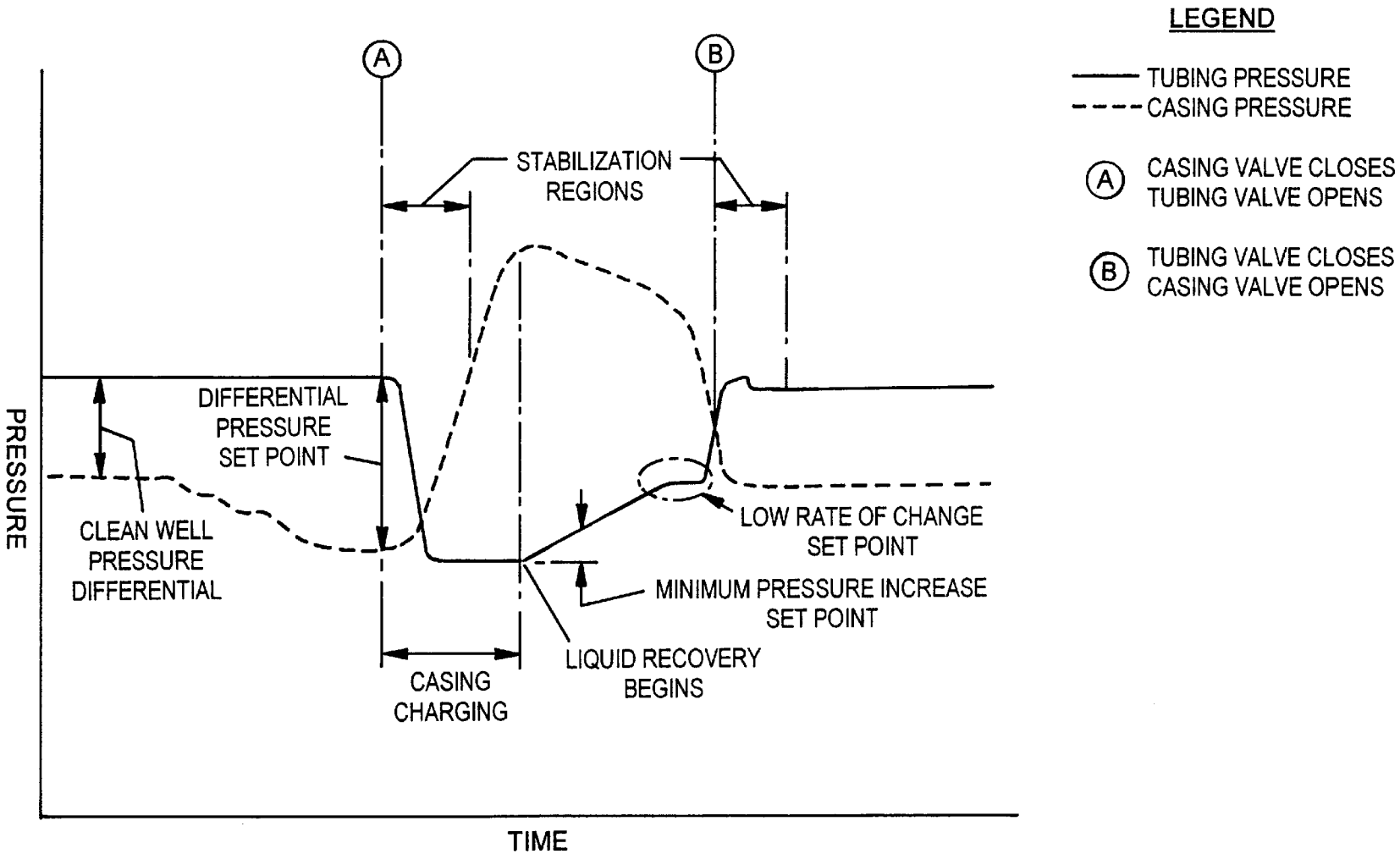
FIG. 8 is a graph of expected pressure trends over time in a typical well employing the system of the present invention.

The optimization software requirements for the switching valve system will depend on how the pressure in the casing and tubing respond to the switching sequence. FIG. 8 shows the expected pressure trend of a typical optimized well site according to the present invention, starting at a Clean Well scenario (see FIG. 2 discussion). The graph demonstrates how the casing pressure in the well drops over time, thus creating an increasing well differential. At time point "A" we have a Loaded Well (see FIG. 3 discussion) wherein the increasing differential triggers the switching system to close the casing and open the tubing. After point "A" the well enters a pressure stabilization area (indicated as a "stabilization region" in the graph), which is represented by a dead band region in the optimization program. The tubing pressure then enters a flat region as the casing charges (FIG. 4 discussion). Once the casing is charged the tubing pressure begins to increase as the liquid is unloaded (refer to "U" tube effect of FIG. 5). Eventually the tubing pressure reaches a steady state (namely a generally flat/horizontal or "low recovery" slope just before time point "B" in the graph) once all the liquid is removed. This second flat slope in the tubing pressure trend triggers the tubing to close and the casing to open, thus returning the system to a normal flowing configuration at time point "B" (see FIG. 6 discussion). Just after time point "B" another stabilization region is required, after which the system is reset and ready to begin the cycle again.

The software requirements are that the program should be able to take certain steps based on pressure set points that may vary with time and location. The set points required for proper functioning of the optimization technology are set out below (some of which appear in FIG. 8).

(a) The Differential Pressure set point relates to the well's pressure differential (indicated by $\Delta P$ in the previous example) and indicates a Loaded Well. This set point is used to initiate the valve switching procedure to remove the excess liquid from the well. It is important that this set point's value not be set too high to avoid overloading the well.

(b) The Minimum Pressure Increase set point is measured on the tubing. Once the tubing is open and the casing is closed, the pressure in the tubing will remain constant until the casing is fully charged. When the system detects that the tubing pressure has increased beyond this set point, the casing is considered charged (as in the FIG. 5 scenario). Once this set point value is exceeded in the tubing, the system begins to monitor pressure trends, and particularly for the low recovery (ie. generally horizontal) slope.

(c) The Low Rate of Change set point is measured as the slope of the tubing pressure. The tubing's pressure has stabilized when it falls below this set point and indicates that the well is fully unloaded. This set point initiates the reverse switching procedure and returns production to the casing (as in the FIG. 6 scenario).

(d) A Maximum Casing Flow Time set point value is measured as the time the casing valve 24 has been open, and is the maximum time which is allowed until the next switching sequence begins, namely, when this amount of time has expired the switching sequence (ie. opening of the tubing valve and closing of the casing valve) will begin whether or not the Differential Pressure set point has been achieved.

(e) A Maximum Tubing Flow Time set point value is measured as the time the tubing valve 25 has been open, and is the maximum time which is allowed until the next switching sequence begins, namely when this amount of time has expired the reverse switching sequence will begin (ie. closing of the tubing valve and opening of the casing valve) to ensure that production is returned to the casing in case of a problem.

(f) A Minimum Casing Flow Time set point value is measured as the time the casing valve has been open, and is the minimum time allowed until the next switching sequence begins, namely the next closing of the casing valve. Hence, a deadband region follows this switching procedure. This set point prevents the system from initiating the next cycle during the deadband time to allow the system to reach equilibrium.

(g) A Minimum Tubing Flow Time set point value represents the duration the tubing valve has been open, and is the minimum time allowed until the next switching sequence begins, namely the next closing of the tubing valve. Hence, another deadband region follows this switching procedure (ie. closing of the tubing valve). This set point also prevents the system from initiating the next cycle during the deadband time to allow the system to reach equilibrium.

(h) A Maximum Casing Valve Closing Time set point represents the time since the "close valve" signal or command is sent to the casing. This value, if exceeded, triggers an alarm and ensures that the casing valve closes within a reasonable amount of time.

(i) A Maximum Tubing Valve Closing Time set point represents the time since the "close valve" signal or command is sent to the tubing. This value, if exceeded, triggers an alarm and ensures that the tubing valve closes within a reasonable amount of time.

(j) A Minimum Casing Valve Closing Time set point represents the time since the "open valve" signal is sent to the casing. It monitors the valve closed indicator to determine when the valve is switched. This value, if exceeded, triggers an alarm and ensures that the casing valve opens within a reasonable time.

(k) A Minimum Tubing Valve Closing Time set point represents the time since the "open valve" signal is sent to the tubing. It monitors the valve closed indicator to determine when the valve is switched. This value, if exceeded, triggers an alarm and ensures that the tubing valve opens within a reasonable time.

Apart from the programming items set out above, instrumentation is needed for the stand alone switching valve system. Referring to FIG. 1, good results have been achieved with the following items.

(1) For the casing valve 24:

(i) a pneumatic pressure valve (full port) connected to the casing and controlled by field instrument gas. This valve should fail closed;

(ii) a solenoid valve 32 mounted on the pressure valve which controls the opening and closing of the casing valve. Alternately, a current-to-pressure transducer 33 may be used in place of the solenoid valve where a more gradual opening and closing of the casing valve is desired to reduce jarring of the valve and avoid disturbance of any particulate matter, such as sand;

(iii) a proximity switch 34 mounted on the pressure valve for indicating when the casing valve is closed; and, (iv) well head insulation in cold weather climates.

(2) For the tubing valve 25:

(i) a pneumatic pressure valve (full port) connected to the tubing and controlled by field instrument gas. This valve should fail open;

(ii) a solenoid valve 35 or a current-to-pressure transducer 36 mounted on a pressure valve which controls the opening and closing of the tubing valve;

(iii) a proximity switch 37 mounted on the pressure valve for indicating when the tubing valve is closed; and, (iv) well head insulation in cold weather climates.

(3) A casing pressure transmitter 30 located up-stream of the casing valve 24 for monitoring the casing pressure.

(4) A tubing pressure transmitter 28 located up-stream of the tubing valve 25 for monitoring the tubing pressure.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below.

We claim:

1. A process for optimizing natural gas production from a well in the presence of liquids, said well having a casing and a tubing landed therein for producing said gas and removing said liquids, said process comprising the steps of:

(a) opening the casing for said gas production and closing said tubing to fluid flow;

(b) monitoring differential pressure between said open casing and said closed tubing;

(c) detecting a loaded well upon said differential pressure reaching a Well Differential Set Point value;

(d) switching gas production to said tubing by closing said casing and opening said tubing;

(e) monitoring pressures of said closed casing and open tubing;

(f) removing said liquids from the well through said tubing, wherein at least some gas production continues through said tubing during said liquid removal; and, (g) returning gas production to said casing when said well is unloaded of said liquid by repeating steps (a) to (g).

2. The process of claim 1 comprising selecting the value of said Well Differential Set Point to avoid overloading said well with said liquids.

3. The process of claim 1 wherein said monitoring in step (e) further includes initiating said returning of gas production in step (g) no later than a Maximum Tubing Flow time from said switching of gas production in step (d).

4. The process of claim 1 wherein said monitoring in step (e) further includes initiating said returning of gas production in step (g) no sooner than a Minimum Tubing Flow time from said switching of gas production in step (d).

5. The process of claim 3 wherein said monitoring in step (e) further includes initiating said returning of gas production in step (g) no sooner than a Minimum Tubing Flow time from said switching of gas production in step (d).

6. The process of claim 1 wherein said monitoring in step (b) further includes initiating said closing of the casing in step (d) no later than a Maximum Casing Flow time from said opening of the casing in step (a).

7. The process of claim 1 wherein said monitoring in step (b) further includes initiating closing of the casing in step (d) no sooner than a Minimum Casing Flow time from said opening of the casing in step (a).

8. The process of claim 6 wherein said monitoring in step (b) further includes initiating closing of the casing in step (d) no sooner than a Minimum Casing Flow time from said opening of the casing in step (a).

9. The process of claim 1 wherein said switching in step (d) further includes triggering an alarm if said casing remains open after a Maximum Casing Closing time from sending of a signal to close said casing.

10. The process of claim 1 wherein said switching in step (d) further includes triggering an alarm if said tubing remains closed after a Minimum Tubing Closing time from sending of a signal to open said tubing.

11. The process of claim 9 wherein said switching in step (d) further includes triggering said alarm if said tubing remains closed after a Minimum Tubing Closing time from sending of a signal to open said tubing.

12. The process of claim 1 further comprising triggering an alarm if said casing remains closed after a Minimum Casing Closing time from sending of a signal to open said casing in step (a).

13. The process of claim 1 further comprising triggering an alarm if said tubing remains open after a Maximum Tubing Closing time from sending of a signal to close said tubing in step (a).

14. The process of claim 13 further comprising triggering said alarm if said tubing remains open after a Maximum Tubing Closing time from sending of a signal to close said tubing in step (a).

15. The process of claim 1 wherein said monitoring in step (e) further comprises monitoring for pressure increases in said open tubing wherein a Minimum Pressure Increase value indicates when said closed casing is considered charged.

16. The process of claim 15 further comprising initiating said returning of gas production in step (g) when, subsequent to said reaching said Minimum Pressure Increase value, said pressure increases in said tubing decrease to a Low Rate of Change value.

17. A method of optimizing natural gas production from a well in the presence of liquids, said well having a casing and a tubing landed therein in a substantially parallel relationship for transporting fluids under pressure from said well, said casing being initially open for gas flow and said tubing being closed to fluid flow, said method comprising the following cycle:

monitoring differential pressure between said open casing and said closed tubing;

detecting a loaded well upon said differential pressure reaching a Well Differential Set Point value selected to avoid overloading said well with said liquids;

switching production to said tubing by closing said casing and opening said tubing, wherein said switching is initiated no sooner than a Minimum Casing Flow time and no later than a Maximum Casing Flow time from opening of said casing;

removing said liquids from said well through said tubing, wherein at least some gas production continues through said tubing during said liquids removal;

monitoring for pressure increases in said open tubing wherein a Minimum Pressure Increase value indicates when said closed casing is considered charged, and, after reaching said Minimum Pressure Increase value, further monitoring said pressure increases for a Low Rate of Change value;

returning production to said casing by opening said casing and closing said tubing when said Low Rate of Change value is reached, wherein said returning is initiated no sooner than a Minimum Tubing Flow time and no later than a Maximum Tubing Flow time from said switching production; and, repeating said cycle to continue said optimized gas production.

18. The method of claim 17 further comprising triggering an alarm in at least one of the following events:

said casing remains closed after a Minimum Casing Closing time from sending a signal to open said casing:

said tubing remains open after a Maximum Tubing Closing time from sending a signal to close said tubing;

said casing remains open after a Maximum Casing Closing time from sending a signal to close said casing; and, said tubing remains closed after a Minimum Tubing Closing time from sending a signal to open said tubing.

19. A switching valve system for a natural gas well using a process for optimizing natural gas production according to claim 1, said well having the casing and the tubing landed in said well for transporting pressurized fluids from said well, said system comprising:

a casing valve for opening and closing said casing to fluid flow;

a tubing valve for opening and closing said tubing to fluid flow;

a first pressure transmitter located up-stream of said casing valve for monitoring fluid pressure therein; and, a second pressure transmitter located upstream of said tubing valve for monitoring fluid pressure therein.

20. The system of claim 19 wherein casing valve comprises a pneumatic pressure valve connected to said casing and adapted to fail closed, any one of a solenoid valve and a current-to-pressure transducer mounted on said pressure valve for controlling opening and closing of the casing valve, and a proximity switch mounted on said pressure valve for indicating when said casing valve is closed.

21. The system of claim 19 wherein tubing valve comprises a pneumatic pressure valve connected to said tubing and adapted to fail open, any one of a solenoid valve and a current-to-pressure transducer mounted on said pressure valve for controlling opening and closing of the tubing valve, and a proximity switch mounted on said pressure valve for indicating when said tubing valve is closed.

* * * * *